US012082662B1

(12) United States Patent
Feirer et al.

(10) Patent No.: US 12,082,662 B1
(45) Date of Patent: Sep. 10, 2024

(54) JEWELRY CHAIN THAT IS CUSTOMIZABLE WITH INTERCONNECTED ACCESSORY CHAINS

(71) Applicant: Southern Kindred, LLC, Cumming, GA (US)

(72) Inventors: Andrea D. Feirer, Cumming, GA (US); Jerrell Carter, Senoia, GA (US)

(73) Assignee: Southern Kindred, LLC, Cumming, GA (US)

( * ) Notice: Subject to any disclaimer, the term of this patent is extended or adjusted under 35 U.S.C. 154(b) by 0 days.

(21) Appl. No.: 18/733,110

(22) Filed: Jun. 4, 2024

(51) Int. Cl.

| | |
|---|---|
| ***A44C 13/00*** | (2006.01) |
| ***A44C 5/02*** | (2006.01) |
| ***A44C 5/20*** | (2006.01) |
| ***A44C 11/00*** | (2006.01) |
| ***A44C 15/00*** | (2006.01) |

(52) U.S. Cl.
CPC ..... *A44C 13/00* (2013.01); *A44C 5/02* (2013.01); *A44C 5/2033* (2013.01); *A44C 11/00* (2013.01); *A44C 15/005* (2013.01)

(58) Field of Classification Search
CPC ..... A44C 5/12; A44C 5/0015; A44C 5/0023; A44C 5/003; A44C 5/0038; A44C 5/0046; A44C 5/0053; A44C 5/0061; A44C 5/0069; A44C 5/0076; A44C 5/0084; A44C 5/0092; A44C 15/00; A44C 15/001; A44C 15/0015; A44C 15/002; A44C 15/0025; A44C 15/003; A44C 15/004; A44C 25/00; A44C 25/001; A44C 11/00
USPC ..... 63/21, 40, 41; D11/3, 6, 8–14
See application file for complete search history.

(56) References Cited

U.S. PATENT DOCUMENTS

| | | | | |
|---|---|---|---|---|
| D810,605 | S * | 2/2018 | Zachos | D11/13 |
| 11,058,190 | B2 * | 7/2021 | Nam | A44C 15/005 |
| 2016/0219990 | A1 * | 8/2016 | Wilder | A44C 11/002 |
| 2019/0281932 | A1 * | 9/2019 | Nam | A44C 5/209 |
| 2020/0337422 | A1 * | 10/2020 | Nam | A44C 11/00 |

* cited by examiner

*Primary Examiner* — Jack W Lavinder
(74) *Attorney, Agent, or Firm* — H. Brock Kolls

(57) ABSTRACT

The present invention relates to a jewelry chain that can be customized with accessory chains. The jewelry chain includes a base chain, base chain segments, terminating base chain segments, and first and second extender links. Each end of the base chain is connected by first extender links to base chain segments and the other end of each of the base chain segments is connected by second extender links to terminating base chain segments. Each of the other ends of the terminating base chain segment can be connected together, in a removable manner, when worn by a user. A first accessory chain can be connected between the first extender link, and/or a second accessory chain can be connected between the second extender links. The first and second accessory chains can be the same length. The base chain and accessory chains are interconnected and displayed without tangling around the wearer's neck.

21 Claims, 9 Drawing Sheets

JEWELRY CHAIN THAT IS CUSTOMIZABLE WITH INTERCONNECTED ACCESSORY CHAINS

TECHNICAL FIELD OF THE INVENTION

This invention relates to a jewelry chain that can be customized with interchangeable accessory chains, and in particular to a base chain and accessory chains that can be interconnected and displayed without tangling around the neck of the wearer.

BACKGROUND OF THE INVENTION

Before our invention, it was common for people to wear more than one chain around their neck. A shortcoming of this approach is that the chains can become intertwined and tangled as they bunch together and overlap at the neckline.

Another shortcoming is that when wearing multiple chains the length of each chain together can be incompatible causing overlapping of the chains that detracts from the presentation appearance as well as creates another way for the chains to become tangled.

Another shortcoming is that since chain length matters to appearance as well as minimizing tangles between the chains, a wearer might not be able to wear their favorite chains together.

The present invention addresses these and other shortcomings by providing a jewelry chain that is customizable with interconnected accessory chains and other advantages. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a jewelry chain that is customizable with interconnected accessory chains. The jewelry chain comprises a base chain, more than one base chain segment, more than one terminating base chain segment, more than one of a first extender link, and more than one of a second extender link. Each end of the base chain is connected by way of one of the first extender links to one end of one of the base chain segments and the other end of each of the base chain segments is connected by way of one of the second extender links to one end of the terminating base chain segment, each of the other ends of the terminating base chain segment can be connected together, in a removable manner, when worn by a user.

Additional shortcomings of the prior art are overcome and additional advantages are provided through the provision of a jewelry chain that is customizable with interconnected accessory chains. The jewelry chain comprises a base chain, more than one base chain segment, more than one terminating base chain segment, more than one of a first extender link, and more than one of a second extender link. Each end of the base chain is connected by way of one of the first extender links to one end of one of the base chain segments and the other end of the base chain segment is connected by way of one of the second extender links to one end of the terminating base chain segment. The other ends of the terminating base chain segment can be connected together, in a removable manner, when worn by a user.

The jewelry chain further comprises at least one of the following a first accessory chain connects at each end to a separate one of the first extender link, or a second accessory chain connects at each end to a separate one of the second extender link, the second accessory chain is the same length as the first accessory chain. In operation, the length of the base chain segment and the length of the terminating base chain segment are selected so that the first accessory chain hangs below the base chain and the second accessory chain hangs above the base chain when worn around by the user.

Additional shortcomings of the prior art are overcome and additional advantages are provided through the provision of a jewelry chain that is customizable with interconnected accessory chains. The jewelry chain comprises a base chain, more than one base chain segment, more than one terminating base chain segment, more than one of a first extender link, and more than one of a second extender link. Each end of the base chain is connected by way of one of the first extender links to one end of one of the base chain segments and the other end of the base chain segment is connected by way of one of the second extender links to one end of the terminating base chain segment. The other ends of the terminating base chain segment can be connected together, in a removable manner, when worn by a user.

The jewelry chain further comprises at least one of the following: a first accessory chain connects at each end to a separate one of the first extender links, or a second accessory chain connects at each end to a separate one of the second extender links. The second accessory chain is the same length as the first accessory chain. In operation, the length of the terminating base chain segments are in the range of 0.75 inches to 1.5 inches and the length of the base chain segments are in the range of 2 inches to 3 inches.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
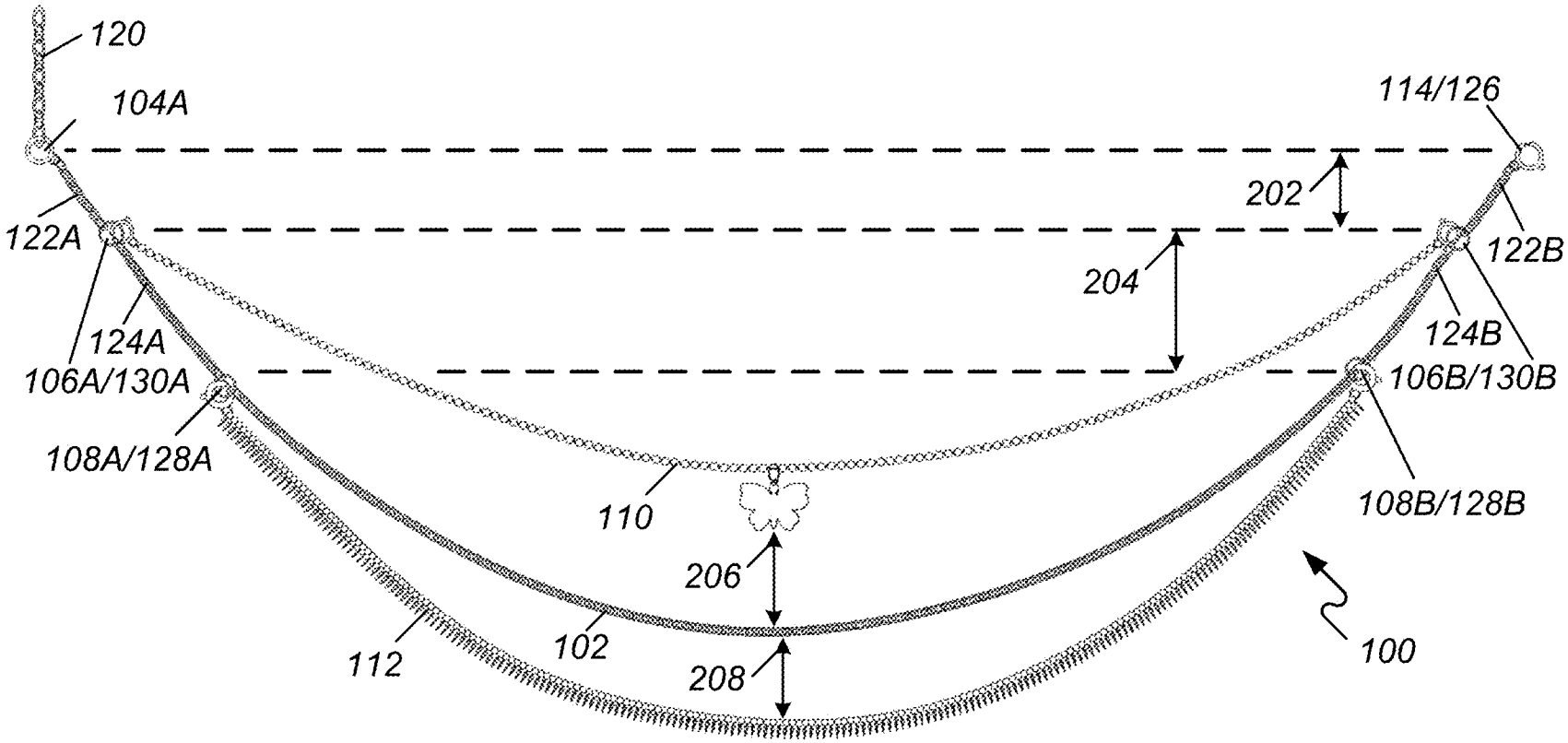
FIGS. 1-6 illustrates examples of a jewelry chain that is customizable with interconnected accessory chains.

Turning now to the drawings in greater detail, it will be seen that in FIG. 1 there is illustrated one example of a jewelry chain 100 customizable with interconnected accessory chains 110/112. In an exemplary embodiment, a base chain 102 can be configured with more than one extender links 106A-B and 108A-B. The extender links 108A-B connect base chain segments 124A-B to the base chain and the extender links 106A-B connect terminating base chain segments 122A-B to the base chain segments 124A-B.

Terminating links 104A-B can be added to the terminating base chain segments 122A-B to aid a user (wearer) 302 in connecting the jewelry chain 100, in a removable manner, for wearing.

In an exemplary embodiment, the extender links 106A-B and 108A-B can be enlarged or otherwise oversized to allow sufficient room for lobster claw style connector 114, ring clip style connector 126, or other suitable style connectors to clip around the extender links 106A-B and 108A-B, and move freely and with binding.

An advantage, in the present invention, is that the length 202 of the terminating base chain segments 122A-B and the length 204 of the base chain segments 124A-B are carefully selected so that a first accessory chain 112 when connected to the extender links 108A-B hangs below the base chain 102 and a second accessory chain 110 when connected to the extender links 106A-B hangs above the base chain 102. This keeps the base chain 102, the first accessory chain 112, and the second accessory chain 110 from becoming tangled together when worn by the user 302. As better illustrated in at least FIG. 2, tangle-free around the wearer's neck is achieved because only the base chain 102 passes behind the neck of the wearer 302 thus preventing tangling between the base chain 102 and the accessory chains 110/112.

Another advantage, in the present invention, is that because of the location of the extender links 106A-B and extender links 108A-B the accessory chains 110/112 lay nicely above and below the base chain 102 preventing tangling and displaying nicely separate on the check of the user 302. To this end, the lengths 204 of the base chain segments 124A-B are equal, the lengths 202 of the terminating base chain segments 122A-B are equal length, and the lengths 204 of the base chain segments 124A-B are greater than the lengths 202 of the terminating base chain segment 122A-B. An exemplary embodiment, the lengths of the terminating base chain segments 122A-B can be in the range of 0.75 inches to 1.5 inches, and the lengths of the base chain segments 124A-B can be in the range of 2 inches to 3 inches.

Another advantage, in the present invention, is that, in a plurality of exemplary embodiment, adjustments to the lengths 202 of the terminating base chain segments 122A-B ranges and the lengths 204 of the base chain segments 124A-B ranges can be made so that the length 204 of the base chain segment and the length 202 of the terminating base chain segment are selected so that the first accessory chain 112 and the second accessory chain 112 each hang, at the lowest apex 226 of the base chain 102, an equal or approximately equal distance 206/208 from the base chain 102 when worn by user 302.

With reference to FIG. 1, in an exemplary embodiment, a jewelry chain 100 customizable with interconnected accessory chains 110/112 can comprise a base chain 102, more than one base chain segment 124A-B, more than one terminating base chain segment 122A-B, more than one of a first extender link 108A-B, and more than one of a second extender link 106A-B. Each end of the base chain 102 can be connected by way of one of the first extender links 106A-B to one end of one of the base chain segments 124A-B and the other end of each of the base chain segments 124A-B can be connected by way of one of the second extender links 108A-B to one end of the terminating base chain segment 122A-B. Each of the other ends of the terminating base chain segments 122A-B can be connected, in a removable manner, when worn by a user. In this regard, terminating links 1-4A-B can be connected to the ends of the terminating base chain segments 122A-B so that the jewelry chain 100 can be clipped together around the neck of user 302. Such clips can be lobster claw style connector 114, ring clip style connector 126, or other suitable connectors as may be required and/or desired in a particular embodiment.

In an exemplary embodiment, one end of the base chain 102 can connect to base chain segment 124A by way of extender link 108A. The terminating base chain segment 122A can connect to the base chain segment 124A by way of extender link 108A. A chain adjustment segment 120 can connect to the terminating base chain segment 122A by way of terminating link 104A.

The other end of the base chain 102 can connect to base chain segment 124B by way of extender link 108B. The terminating base chain segment 122B can connect to the base chain segment 124B by way of extender link 108B. A lobster claw style connector 114, ring clip style connector 126, or other suitable clip can connect to the terminating base chain segment 122B.

Figure 3:
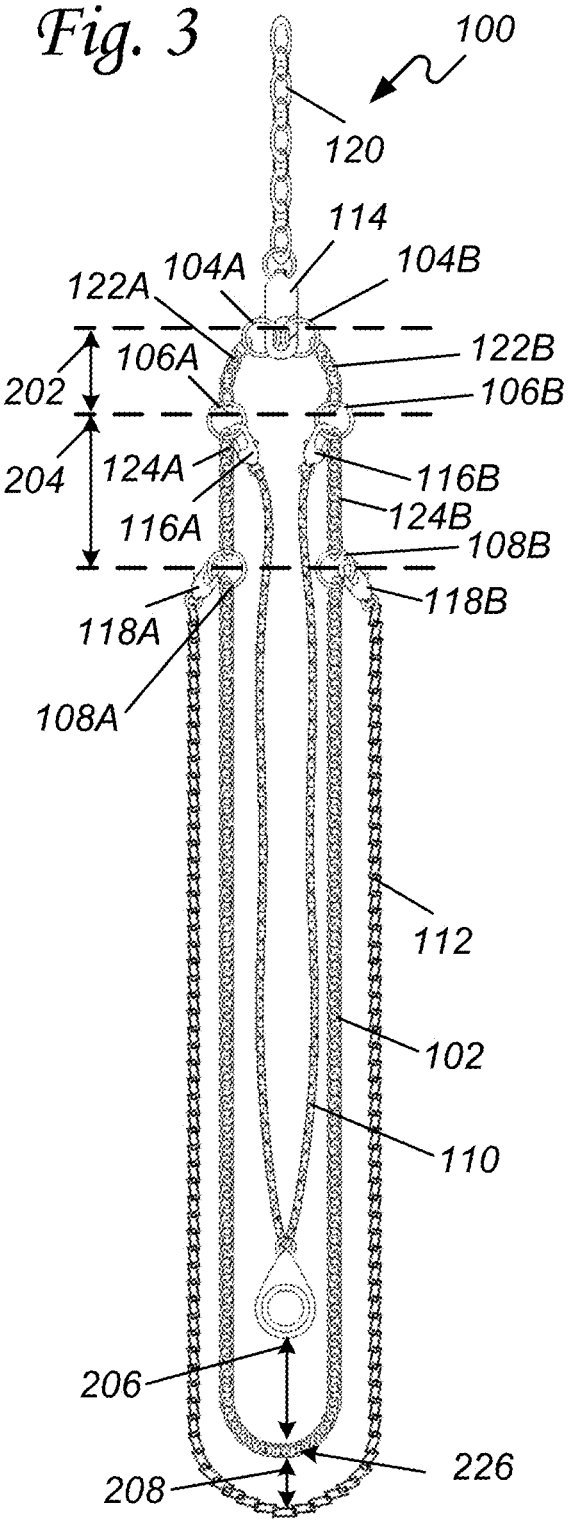
Figure 4:
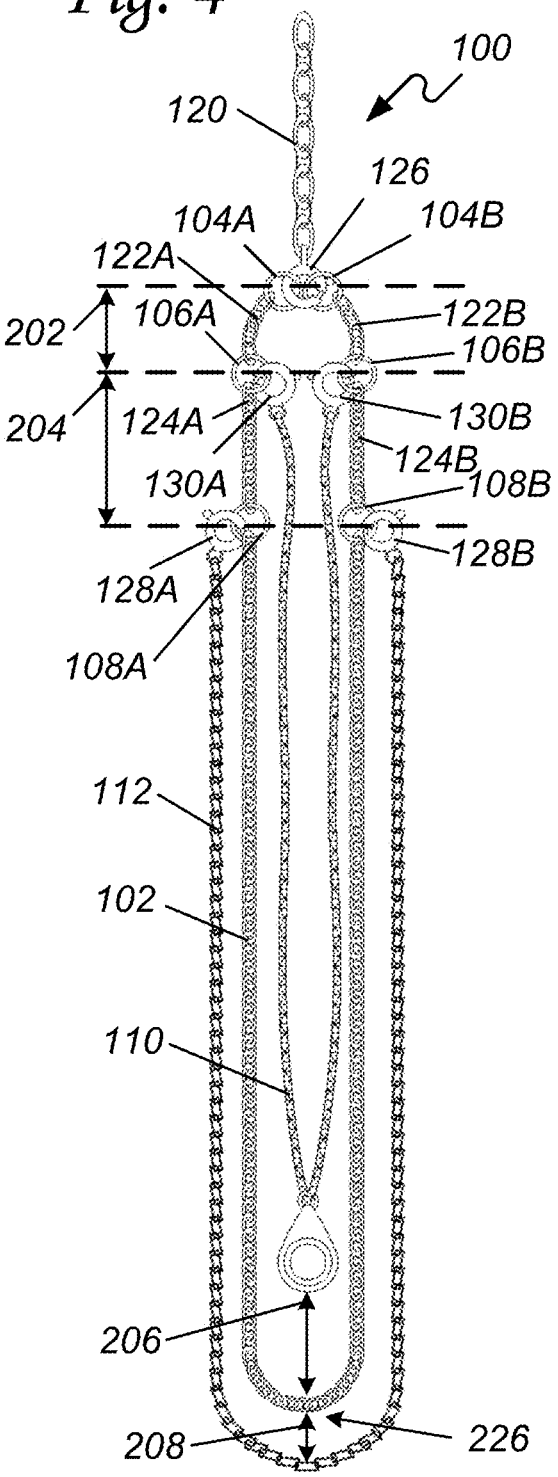

In operation and with reference to at least FIGS. 3 and 4, the jewelry chain 100 can be secured around the neck of user 302 by way of the lobster claw style connector 114, ring clip style connector 126, or other suitable connector, in a removable manner, with one or the links in the adjustment segment 120 or terminating link 104A.

In an exemplary embodiment, the first accessory chain 112 can be connected at each end to a separate one of the first extender links 108A-B. A lobster claw style connector 118A-B (See at least FIG. 3), ring clip style connector 128A-B (See at least FIG. 4), or other suitable clip can be attached to the ends of the first accessory chain and used to clip the accessory chain, in a removable manner, to the base chain 102 by way of the first extender links 108A-B.

In an exemplary embodiment, the second accessory chain 112 can be connected at each end to a separate one of the second extender links 106A-B. A lobster claw style connector 116A-B (See at least FIG. 3), ring clip style connector 130A-B (See at least FIG. 4), or other suitable clip can be attached to the ends of the first accessory chain and used to clip the accessory chain, in a removable manner, to the base chain 102 by way of the first extender links 106A-B.

Figure 2:
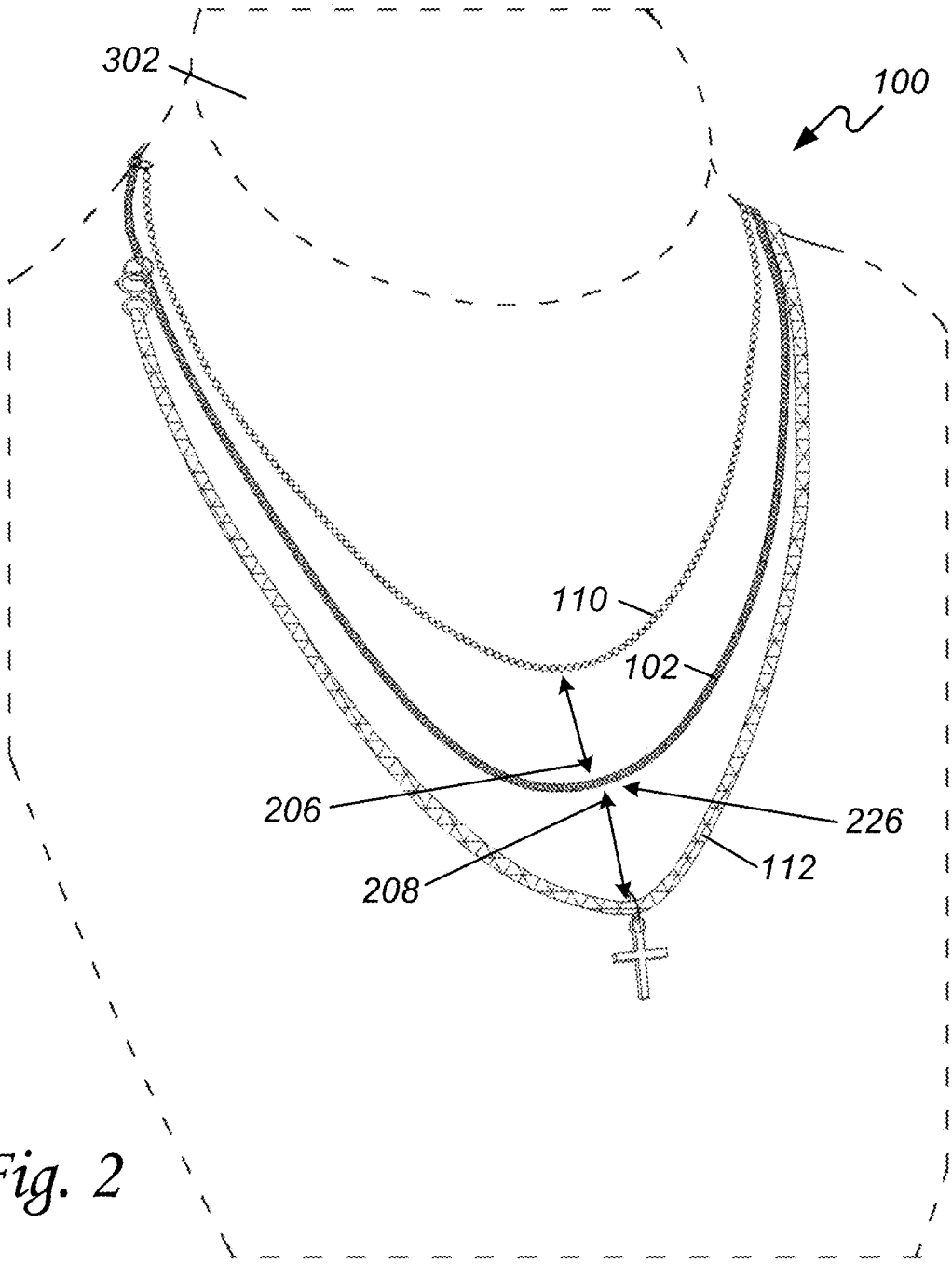

Referring to FIG. 2, there is illustrated one example of a jewelry chain 100 that can be customized with accessory chains 110/112. In an exemplary embodiment, the length of the base chain segments 124A-B and the length of the terminating base chain segments 122A-B can be selected so that the first accessory chain 112 hangs below 208 the base chain 102 and the second accessory chain 110 hangs above 206 the base chain when worn around by the user.

An advantage, in the present invention, is that each of the accessory chains 110/112 can be the same length and interchangeably connected in the first accessory chain 112 positions or the second accessory chain 110 positions, and they hang around the neck of the user 302 tangle-free and correctly well spaced with regards to the base chain 102. This allows user 302 to acquire many different kinds of accessory chains that are of the same length and wear them in either the first accessory chain 112 or the second accessory chain 110 positions. Flexibility in choosing the accessory chain and its position with regards to the base chain 102 gives the user 302 many customizable options.

Referring to FIGS. 3 and 4, there are illustrated examples of a jewelry chain 100 that can be customized with accessory chains 110/112. In an exemplary embodiment, the jewelry chain can comprise a base chain 102, more than one base chain segment 124A-B, more than one terminating base chain segment 122A-B, more than one of a first extender link 108A-B, and more than one of a second extender link 106A-B.

Each end of the base chain can be connected by way of one of the first extender links 108A or 108B to one end of one of the base chain segments 124A or 124B and the other end of the base chain segment 124A or 124B can be connected by way of one of the second extender link 106A or 106B to one end of the terminating base chain segment 122A or 122B. The other ends of the terminating base chain segment 122A-B can comprise terminating link 104A-B, lobster claw style clip connection 114, ring style clip connector 126, or other suitable conning method, in a removable manner, when worn by a user 302.

In an exemplary embodiment, a first accessory chain 112 can be connected at each end to a separate one of the first extender link 108A-B, and/or a second accessory chain 110 can be connected at each end to a separate one of the second extender link 106A-B. The second accessory chain 110 can be the same length as the first accessory chain 112.

An advantage, in the present invention, is that in operation, the length 204 of the base chain segments 124A-B and the length 202 of the terminating base chain segment can be selected so that the first accessory chain 112 hangs below the base chain 102 and the second accessory chain 110 hangs above the base chain 102 when worn by the user even though the second accessory chain 110 is the same length as the first accessory chain 112.

Figure 5:
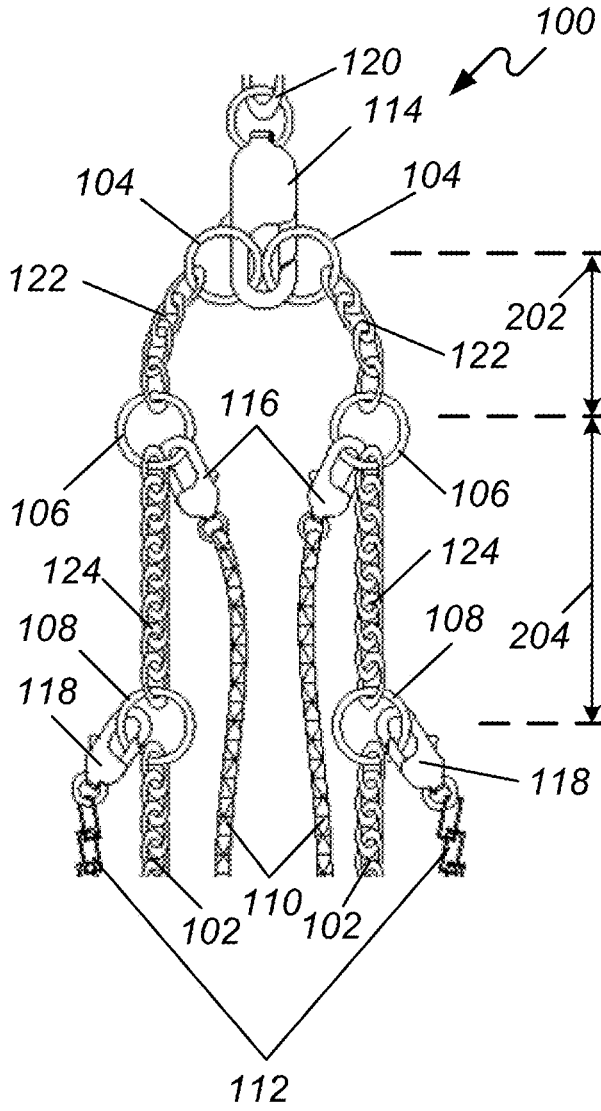
Figure 6:
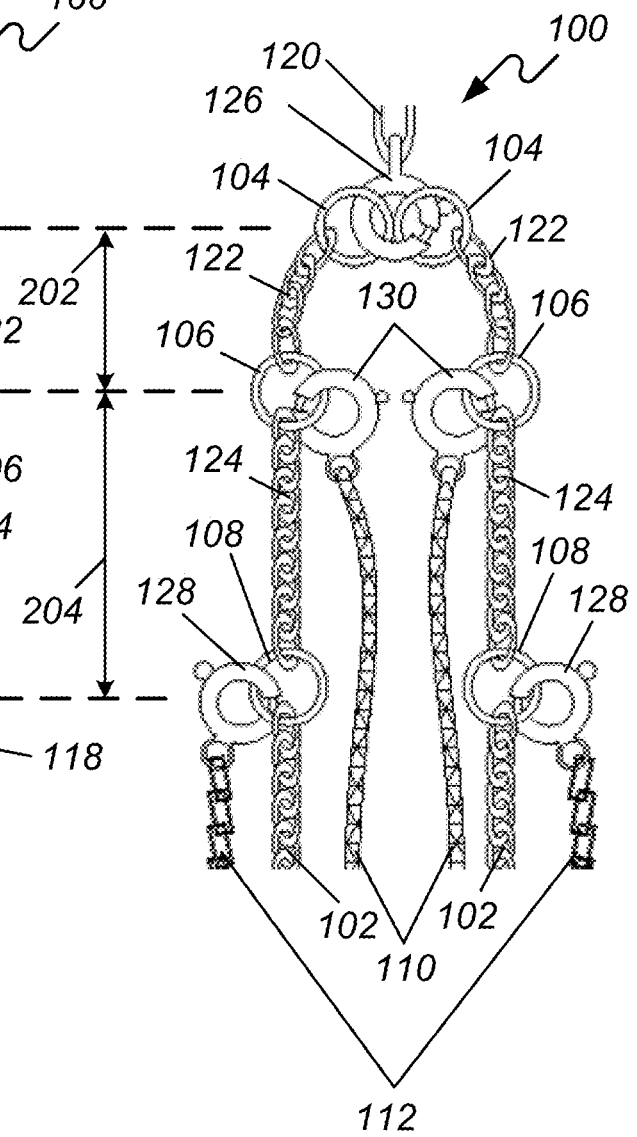

With reference to FIGS. 3-6, the use of lobster claw style connectors 114, 116A-B, and 118A-B are illustrated. With reference to FIGS. 4 and 6, ring style connectors 126, 128A-B, and 130A-B are illustrated. Such lobster claw style connectors and ring style connectors can be interchangeably used in the present invention. Additionally, other types and/or kinds of connectors can be used, as may be required and/or desired in a particular embodiment.

Referring to FIGS. 5 and 6, there are illustrated examples of a jewelry chain 100 that can be customized with accessory chains 110/112. In an exemplary embodiment, the jewelry chain 100 can be customized with one or more accessory chains. The jewelry chain 100 comprises a base chain 102, more than one base chain segment 124, more than one terminating base chain segment 122, more than one of a first extender link 108, and more than one of a second extender link 106

Each end of the base chain 102 can be connected by way of one of the first extender link 108 to one end of one of the base chain segment 124 and the other end of the base chain segment 124 can be connected by way of one of the second extender link 106 to one end of the terminating base chain segment 122. The other ends of the terminating base chain segment 122A-B can comprise terminating link 104A-B, lobster claw style clip connection 114, ring style clip connector 126, or other suitable conning method, in a removable manner, when worn by a user 302.

In an exemplary embodiment, a first accessory chain 112 can be connected at each end to a separate one of the first extender link 108, and/or a second accessory chain 110 can be connected at each end to a separate one of the second extender link 106. The second accessory chain 110 is the same length as the first accessory chain 112.

In an exemplary embodiment, the length of the terminating base chain segment 122 can be in the range of 0.75 inches to 1.5 inches and the length of the base chain segment 124 can be in the range of 2 inches to 3 inches.

Figure 7:
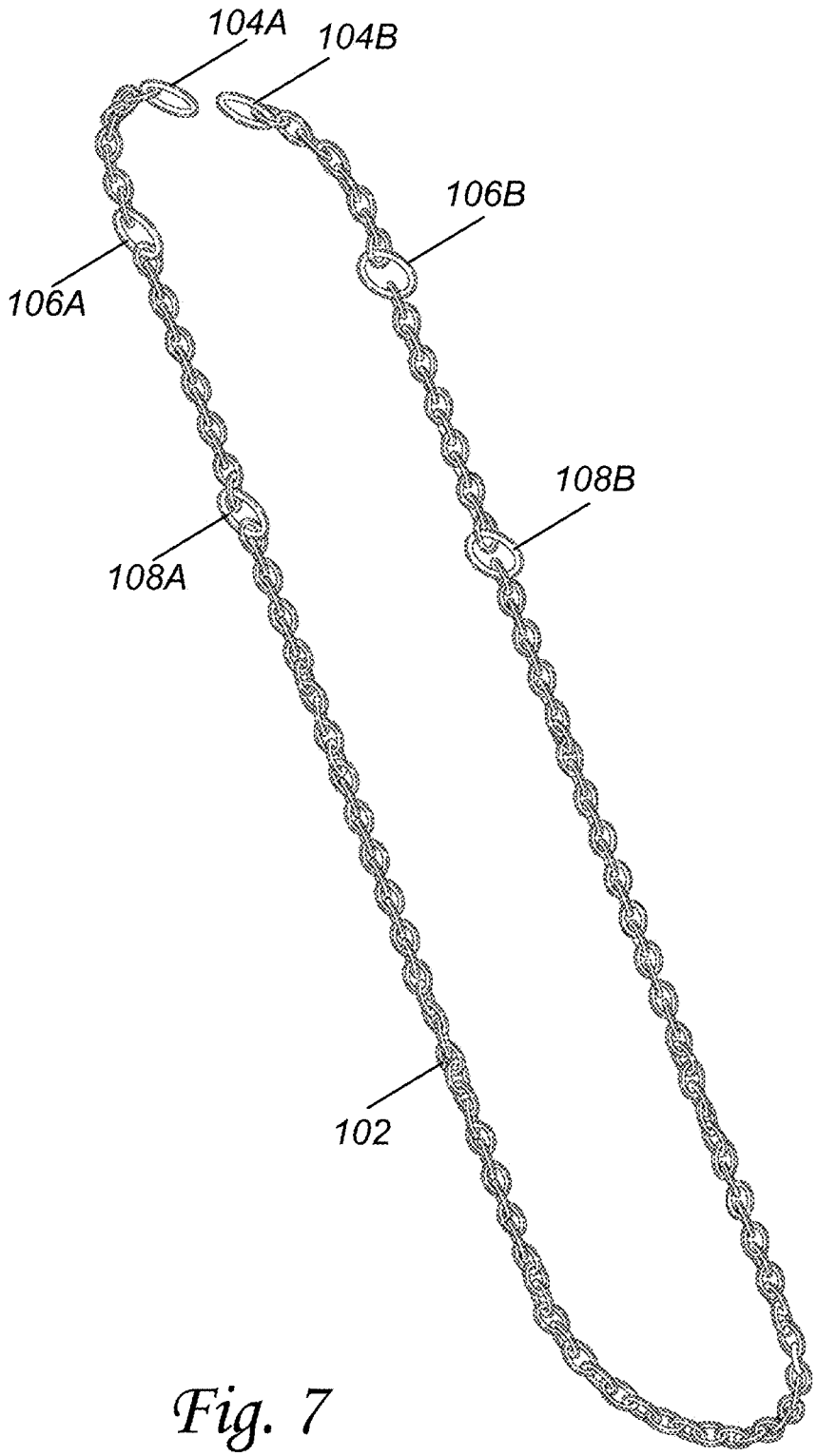
FIGS. 7-13 illustrates examples of a base chain.
Figure 8:
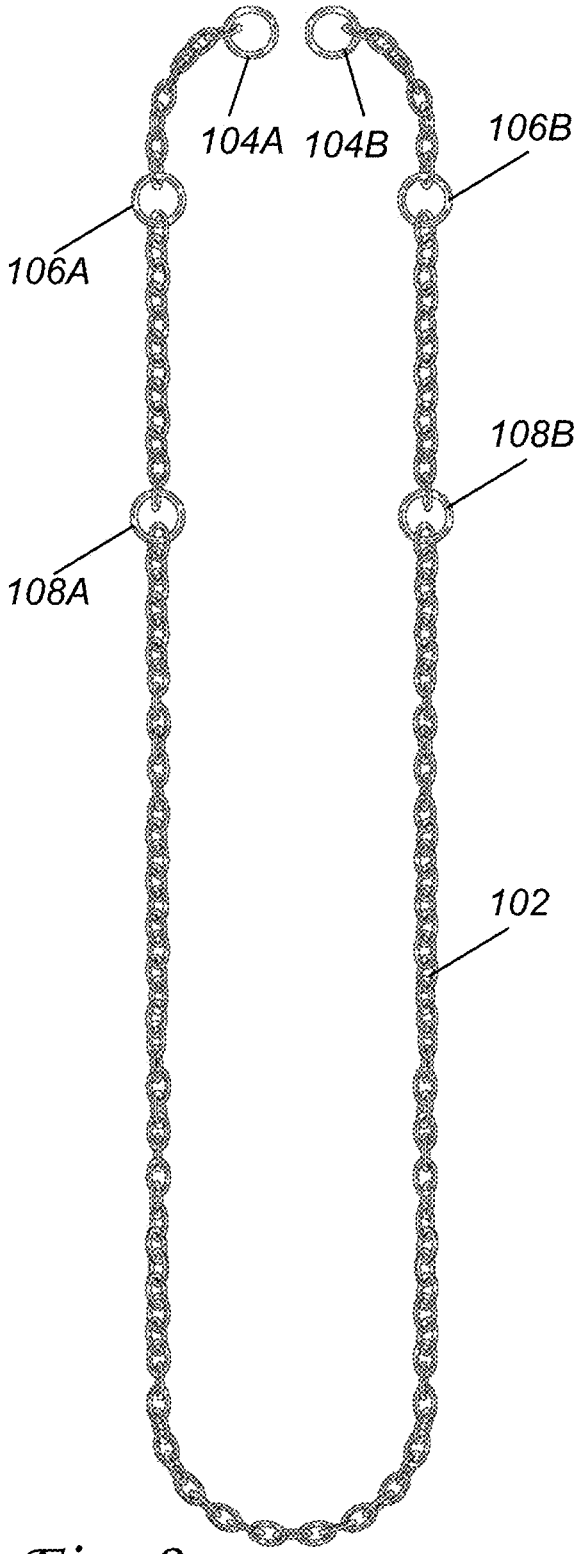
Figure 9:
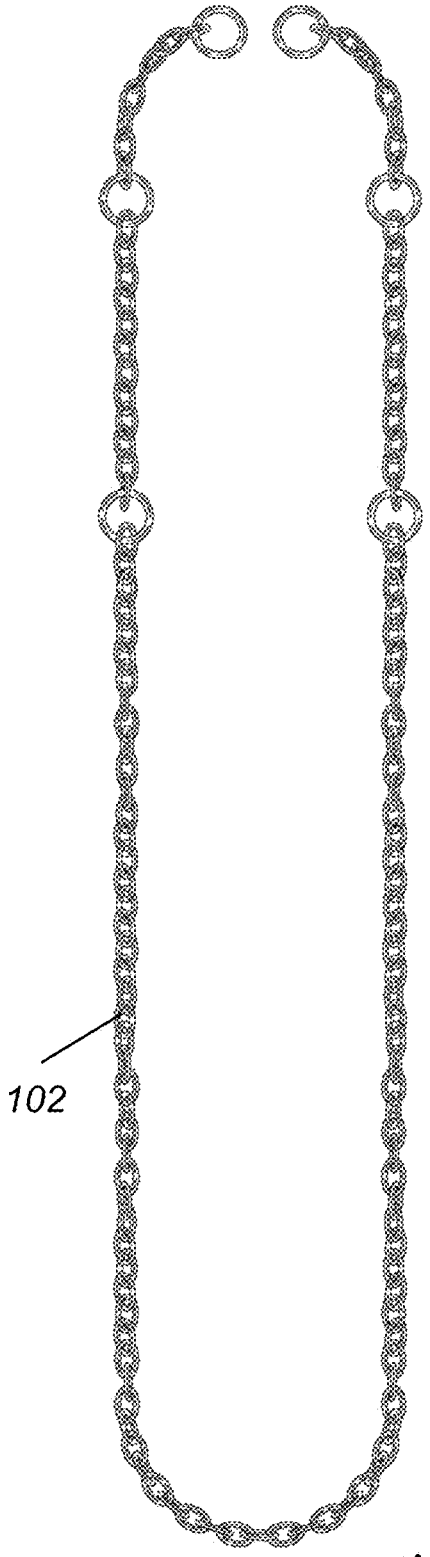
Figure 10:
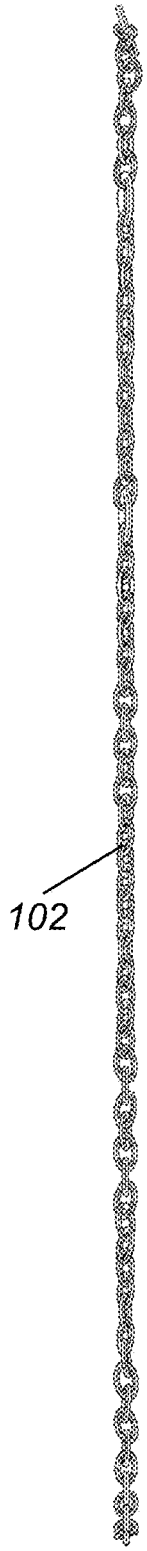
Figure 11:
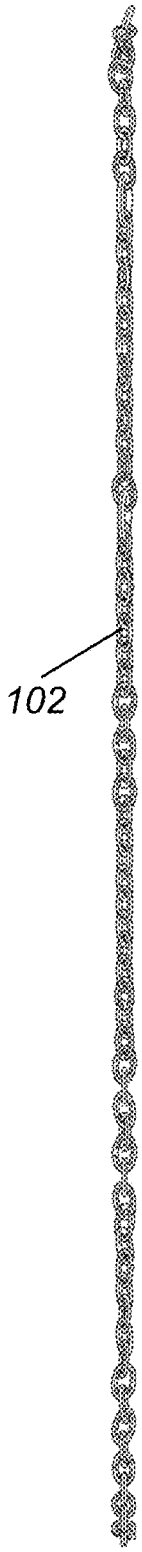
Figure 12:
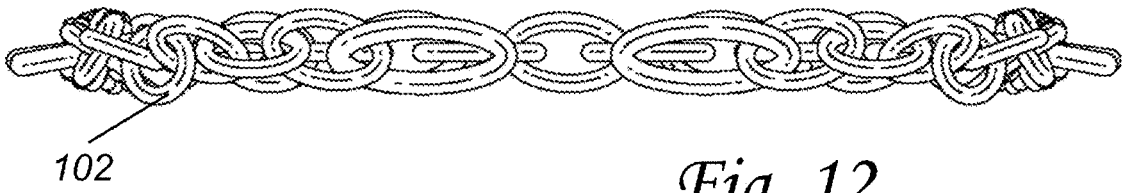
Figure 13:
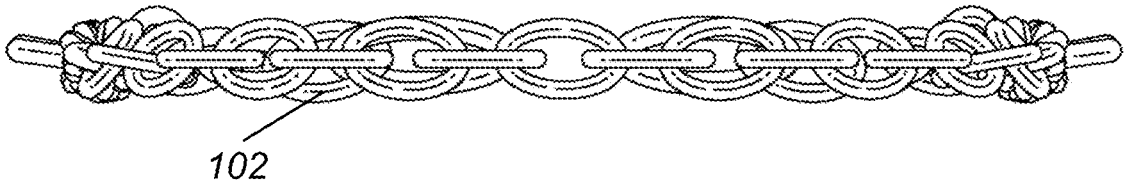

Referring to FIG. 7, there is illustrated a perspective view of the base chain 102. Referring to FIG. 8, there is illustrated a front view of the base chain 102. Referring to FIG. 9, there is illustrated a back view of the base chain 102. Referring to FIG. 10, there is illustrated the left side of the base chain 102. Referring to FIG. 11, there is illustrated a right side view of the base chain 102. Referring to FIG. 12, there is illustrated a top view of the base chain 102. Referring to FIG. 13, there is illustrated a bottom view of the base chain 102.

Figure 14:
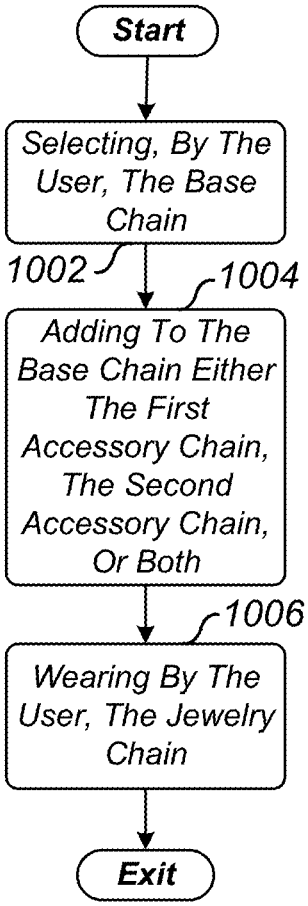
FIG. 14 illustrates one example of a method of using a jewelry chain that is customizable with interconnected accessory chains.

Referring to FIG. 14, there is illustrated one example of a method of using a jewelry chain 100 that can be customized with one or more accessory chains. In an exemplary embodiment, the method begins in step 1002 by selecting, by user 302, the base chain 102 to customize with one or more accessory chains 110/112. Continuing in step 1004 by adding to the base chain 102 either the first accessory chain 112, the second accessory chain 110, or both 110/112. And, continuing in step 1006 by wearing, by user 302, the jewelry chain 102.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A jewelry chain that is customizable with interconnected accessory chains, the jewelry chain comprising:

a base chain;

more than one of a base chain segment;

more than one of a terminating base chain segment;

more than one of a first extender link; and more than one of a second extender link;

each end of the base chain is connected by way of one of the first extender link to one end of one of the base chain segment and the other end of each of the base chain segment is connected by way of one of the second extender link to one end of the terminating base chain segment, each of the other ends of the terminating base chain segment can be connected together, in a removable manner, when worn by a user;

wherein the length of each of the base chain segment is equal, the length of each of the terminating base chain segment is equal, and the length of the base chain segment is greater than the length of the terminating base chain segment.

2. The jewelry chain in accordance with claim 1, the length of the terminating base chain segment is in the range of 0.75 inches to 1.5 inches and the length of the base chain segment is in the range of 2 inches to 3 inches.

3. The jewelry chain in accordance with claim 1, further comprising:

a first accessory chain connects at each end to a separate one of the first extender link.

4. The jewelry chain in accordance with claim 1, the first accessory chain connects to the first extender link by way of a lobster claw style connector.

5. The jewelry chain in accordance with claim 3, the first accessory chain connects to the first extender link by way of a ring clip style connector.

6. The jewelry chain in accordance with claim 3, further comprising:

a second accessory chain connects at each end to a separate one of the second extender link.

7. The jewelry chain in accordance with claim 6, further comprising:

more than one of a lobster claw style connector, the second accessory chain connects to the second extender link by way of the lobster claw style connector.

8. The jewelry chain in accordance with claim 6, further comprising:

more than one of a ring clip style connector, the second accessory chain connects the second extender link by way of the ring clip style connector.

9. The jewelry chain in accordance with claim 6, further comprising:

the first accessory chain is equal in length to the second accessory chain.

10. The jewelry chain in accordance with claim 6, wherein the length of the base chain segment and the length of the terminating base chain segment are selected so that the first accessory chain and the second accessory chain each hang, at the lowest apex of the base chain, an equal distance from the base chain when worn around by the user.

11. The jewelry chain in accordance with claim 6, wherein the length of the base chain segment and the length of the terminating base chain segment are selected so that the first accessory chain hangs below the base chain and the second accessory chain hangs above the base chain when worn around by the user.

12. A method of using the jewelry chain of claim 1, comprising the steps of:

selecting, by the user, the base chain to customize with one or more accessory chains;

adding to the base chain either the first accessory chain, the second accessory chain, or both; and wearing, by the user, the jewelry chain.

13. A jewelry chain that is customizable with interconnected accessory chains, the jewelry chain comprising:

a base chain;

more than one of a base chain segment;

more than one of a terminating base chain segment;

more than one of a first extender link;

more than one of a second extender link;

each end of the base chain is connected by way of one of the first extender link to one end of one of the base chain segment and the other end of the base chain segment is connected by way of one of the second extender link to one end of the terminating base chain segment, the other ends of the terminating base chain segment can be connected together, in a removable manner, when worn by a user; and one of the following:

a first accessory chain connects at each end to a separate one of the first extender link;

a second accessory chain connects at each end to a separate one of the second extender link; or a first accessory chain connects at each end to a separate one of the first extender link and a second accessory chain connects at each end to a separate one of the second extender link, the second accessory chain is the same length as the first accessory chain;

wherein the length of the base chain segment and the length of the terminating base chain segment are selected so that the first accessory chain hangs below the base chain and the second accessory chain hangs above the base chain when worn around by the user.

14. The jewelry chain in accordance with claim 13, wherein the length of the base chain segment is greater than the length of the terminating base chain segment.

15. The jewelry chain in accordance with claim 14, wherein the length of the base chain segment and the length of the terminating base chain segment are selected so that the first accessory chain and the second accessory chain each hang, at the lowest apex of the base chain, an equal distance from the base chain when worn around by the user.

16. A jewelry chain that is customizable with interconnected accessory chains, the jewelry chain comprising:

a base chain;

more than one of a base chain segment;

more than one of a terminating base chain segment;

more than one of a first extender link;

more than one of a second extender link;

each end of the base chain is connected by way of one of the first extender link to one end of one of the base chain segment and the other end of the base chain segment is connected by way of one of the second extender link to one end of the terminating base chain segment, the other ends of the terminating base chain segment can be connected together, in a removable manner, when worn by a user; and one of the following:

a first accessory chain connects at each end to a separate one of the first extender link;

a second accessory chain connects at each end to a separate one of the second extender link; or a first accessory chain connects at each end to a separate one of the first extender link and a second accessory chain connects at each end to a separate one of the second extender link, the second accessory chain is the same length as the first accessory chain;

wherein the length of the terminating base chain segment is in the range of 0.75 inches to 1.5 inches and the length of the base chain segment is in the range of 2 inches to 3 inches.

17. The jewelry chain in accordance with claim 16, wherein the length of the base chain segment and the length of the terminating base chain segment are selected so that the first accessory chain and the second accessory chain each hang, at the lowest apex, an equal distance from the base chain when worn around by the user.

18. The jewelry chain in accordance with claim 16, further comprising:

more than one of a lobster claw style connector, the lobster claw style connector connects the first accessory chain or the second accessory chain to the base chain.

19. The jewelry chain in accordance with claim 16, further comprising:

more than one of a ring clip style connector, the ring clip style connector connects the first accessory chain or the second accessory chain to the base chain.

20. A jewelry chain that is customizable with interconnected accessory chains, the jewelry chain comprising:

a base chain;

more than one of a base chain segment;

more than one of a terminating base chain segment;

more than one of a first extender link;

more than one of a second extender link;

each end of the base chain is connected by way of one of the first extender link to one end of one of the base chain segment and the other end of each of the base chain segment is connected by way of one of the second extender link to one end of the terminating base chain segment, each of the other ends of the terminating base chain segment can be connected together, in a removable manner, when worn by a user;

a first accessory chain connects at each end to a separate one of the first extender link; and a second accessory chain connects at each end to a separate one of the second extender link;

wherein the length of the base chain segment and the length of the terminating base chain segment are selected so that the first accessory chain and the second accessory chain each hang, at the lowest apex of the base chain, an equal distance from the base chain when worn around by the user.

21. A jewelry chain that is customizable with interconnected accessory chains, the jewelry chain comprising:

a base chain;

more than one of a base chain segment;

more than one of a terminating base chain segment;

more than one of a first extender link;

more than one of a second extender link;

each end of the base chain is connected by way of one of the first extender link to one end of one of the base chain segment and the other end of each of the base chain segment is connected by way of one of the second extender link to one end of the terminating base chain segment, each of the other ends of the terminating base chain segment can be connected together, in a removable manner, when worn by a user;

a first accessory chain connects at each end to a separate one of the first extender link; and a second accessory chain connects at each end to a separate one of the second extender link;

wherein the length of the base chain segment and the length of the terminating base chain segment are selected so that the first accessory chain hangs below the base chain and the second accessory chain hangs above the base chain when worn around by the user.

* * * * *